US007429956B2

(12) United States Patent
Park et al.

(10) Patent No.: US 7,429,956 B2
(45) Date of Patent: Sep. 30, 2008

(54) ANTENNA

(75) Inventors: Cheul-hae Park, Suwon-si (KR); Chun-min Jung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/655,874

(22) Filed: Jan. 22, 2007

(65) Prior Publication Data

US 2008/0062051 A1 Mar. 13, 2008

(30) Foreign Application Priority Data

Sep. 11, 2006 (KR) ..... 10-2006-0087468

(51) Int. Cl.
*H01Q 1/24* (2006.01)

(52) U.S. Cl. ..... 343/702; 343/882

(58) Field of Classification Search ..... 343/702, 343/880, 882, 906

See application file for complete search history.

(56) References Cited

U.S. PATENT DOCUMENTS 6,064,343 A * 5/2000 Crowley et al. ..... 343/702
6,232,924 B1 * 5/2001 Winstead et al. ..... 343/702
6,301,489 B1 * 10/2001 Winstead et al. ..... 455/575.7
7,138,959 B2 * 11/2006 Gaudette et al. ..... 343/878

FOREIGN PATENT DOCUMENTS

KR 2006-35497 4/2006

* cited by examiner

*Primary Examiner*—Tho G Phan
(74) *Attorney, Agent, or Firm*—Stein, McEwen & Bui, LLP

(57) ABSTRACT

Provided is an antenna including: an antenna stick; and an antenna hinge pivotably attaching the antenna stick to an electronic device body. The antenna hinge includes: a support plate fixed to and combined with the electronic device body; a first connector connected to the antenna stick and pivotably combined with the support plate; a second connector deviating from a pivot center of the first connector and fixed in respect of the support plate; a third connector moving with the pivot of the first connector; and a spring having an elastic force varying with a distance between the second connector and the third connector. If the first connector pivots until the third connector passes a virtual first straight line connecting the pivot center of the first connector and the second connector, the first connector continuously pivots toward an identical direction due to an elastic restoring force of the spring.

20 Claims, 6 Drawing Sheets

ANTENNA

CROSS-REFERENCE TO RELATED APPLICATIONS

This application claims all benefits accruing under 35 U.S.C. §119 from Korean Patent Application No. 2006-87468, filed on Sep. 11, 2006, in the Korean Intellectual Property Office, the disclosure of which is incorporated herein by reference.

BACKGROUND OF THE INVENTION

1. Field of the Invention

The present invention relates to an antenna installed in an electronic device, and more particularly, to an antenna pivotably installed in a body of an electronic device.

2. Related Art

Antennas are attached to various types of portable electronic devices including, for example, radios, cellular phones, portable multimedia players (PMPs) receiving digital multimedia broadcasts (DMBs), and personal digital assistants (PDAs) to receive radio waves. Stick type antennas are designed to stand only when a portable electronic device needs to receive radio waves, for portable convenience. In one type of stick antenna, an antenna stick may be drawn from a body of an electronic device to stand when an electronic device requires reception of radio waves. In another type of stick antenna, an antenna stick may pivot on the body to stand when the electronic device requires reception of radio waves.

FIG. 1A is a plan view illustrating a state of a conventional antenna which is folded, and FIG. 1B is a plan view illustrating a state of a conventional antenna which is unfolded. Referring to FIGS. 1A and 1B, an antenna 10 includes an antenna stick 11 and an antenna hinge 15. The antenna stick 11 pivots on the body of an electronic device to stand the antenna 10. The antenna hinge 15 hinges the antenna stick 11 so that the antenna stick 11 pivots on the body of the electronic device. The antenna hinge 15 includes a support plate 16 fixed to and combined with a frame 5 in the body of the electronic device, a pivoting body 20 combined with the support plate 16 to pivot on the support plate 16 clockwise and counterclockwise, and a plate spring 18 installed on the support plate 16. The plate spring 18 includes a protrusion 19 protruding toward an external circumference of the support plate 16. The pivoting body 20 includes first and second grooves 21 and 22 into which the protrusion 19 of the plate spring 18 is inserted.

When the protrusion 19 of the plate spring 18 is inserted into the first groove 21 of the pivoting body 20 as shown in FIG. 1A, the antenna stick 11 is folded over the body of the electronic device. If a user presses a handle 25 protruding from an outer surface of the pivoting body 20 to lower the handle 25 up to a position shown in FIG. 1B, the plate spring 18 elastically shrinks and the pivoting body 20 pivots on the support plate 16 and the frame 5 clockwise. Also, the protrusion 19 elastically protrudes to be inserted into the second groove 22 when the second groove 22 overlaps with the protrusion 19. The antenna stick 11 connected to the pivoting body 20 stands due to the pivot of the pivoting body 20.

However, the pivoting body 20 must pivot at an angle at which the antenna stick 11 pivots, by a force of a user to stand the folded antenna stick 11 or fold the standing antenna stick 11. Thus, it is difficult and inconvenient to fold and/or stand the antenna stick 11. In addition, the antenna stick 11 does not smoothly pivot due to friction between the pivoting body 20 and the protrusion 19 of the plate spring 18. Moreover, excessive force is also required to pivot the antenna stick 11.

SUMMARY OF THE INVENTION

Several aspects and exemplary embodiments of the present invention provide an antenna including an antenna stick which can pivot at an angle representing a user's desire to stand and/or fold the antenna stick, so that the antenna stick stands and/or is folded without a further force.

Additional aspects and/or advantages of the invention will be set forth in part in the description which follows and, in part, will be obvious from the description, or may be learned by practice of the invention.

According to an aspect of the present invention, there is provided an antenna including an antenna stick and an antenna hinge pivotably attaching the antenna stick to an electronic device body; wherein the antenna hinge comprises a support plate fixed to the electronic device body; a first connector connected to the antenna stick so as to pivot between a closed position and an open position; a second connector fixed to the support plate at a location other than a pivot center of the first connector; a third connector coupled to the first connector so as to pivot with the first connector; and a spring coupled to the third connector and having an elastic force varying with the distance between the second connector and the third connector, wherein if the first connector pivots in a given direction until the first connector has pivoted beyond a predetermined point, the first connector continues to pivot in the given direction due to the elastic restoring force of the spring.

According to another aspect of the present invention, the spring may be disposed between the second connector and the third connector so as to extend and/or shorten.

According to another aspect of the present invention, the second connector and the third connector may include a first stud a second stud, respectively.

According to another aspect of the present invention, the antenna may further include a first bracket supporting the second stud and connected to the first stud so as to slide and pivot on the first stud.

According to another aspect of the present invention, the antenna may further include a second bracket pivotably connected to the first stud, wherein the spring is interposed between the first and second studs.

According to another aspect of the present invention, the antenna may further include a spring guide stick, wherein the spring is a coil spring, and the spring guide stick penetrates the coil spring to support the coil spring.

According to another aspect of the present invention, the antenna may further include a first stud support bracket supporting the first stud and fixed to and supported by the support plate.

According to another aspect of the present invention, the spring may be a compression spring, wherein the spring is compressed until the third connector passes the predetermined point but extends if the third connector passes the predetermined point.

According to another aspect of the present invention, the antenna may further include a stopper limiting a pivot range of the antenna stick.

According to another aspect of the present invention, the antenna may further include a handle pivoting the first connector using a human power.

in addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1A:
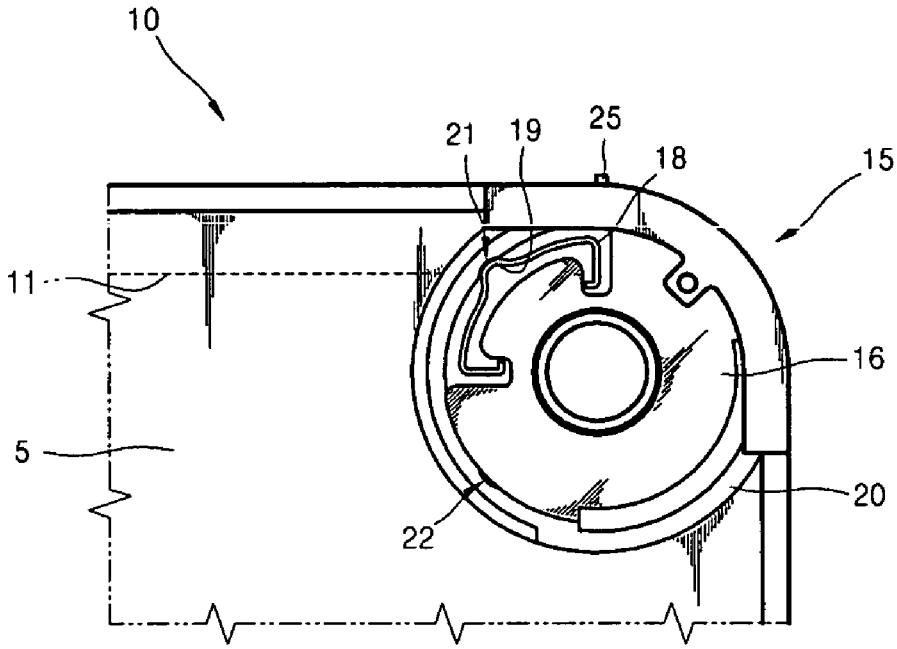
FIG. 1A (RELATED ART)
FIG. 1A is a plan view illustrating a state of a conventional antenna which is folded.
Figure 1B:
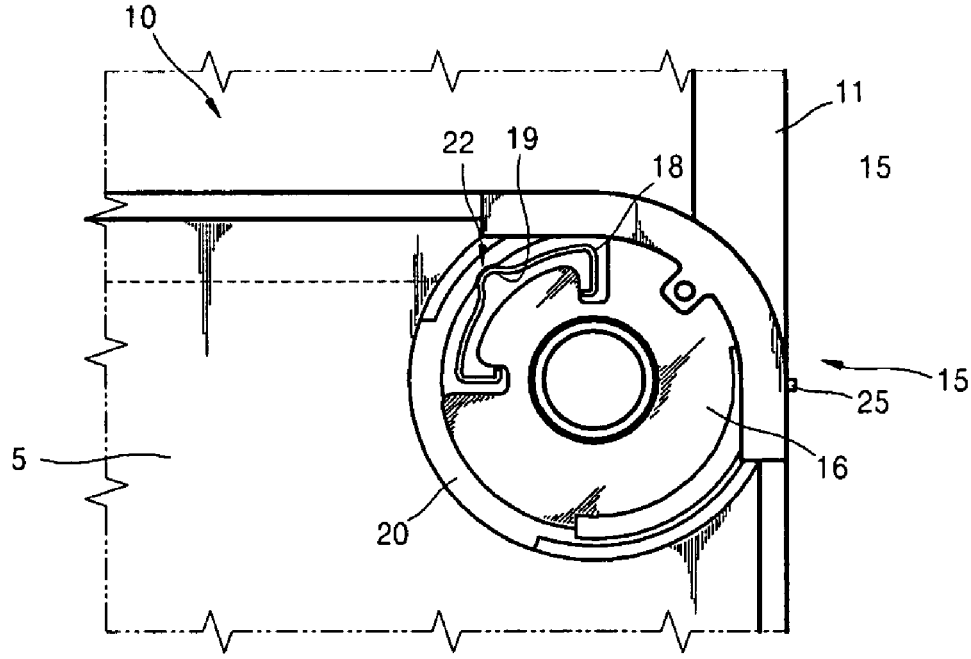
FIG. 1B (RELATED ART)
FIG. 1B is a plan view illustrate a state of the conventional antenna which is unfolded.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
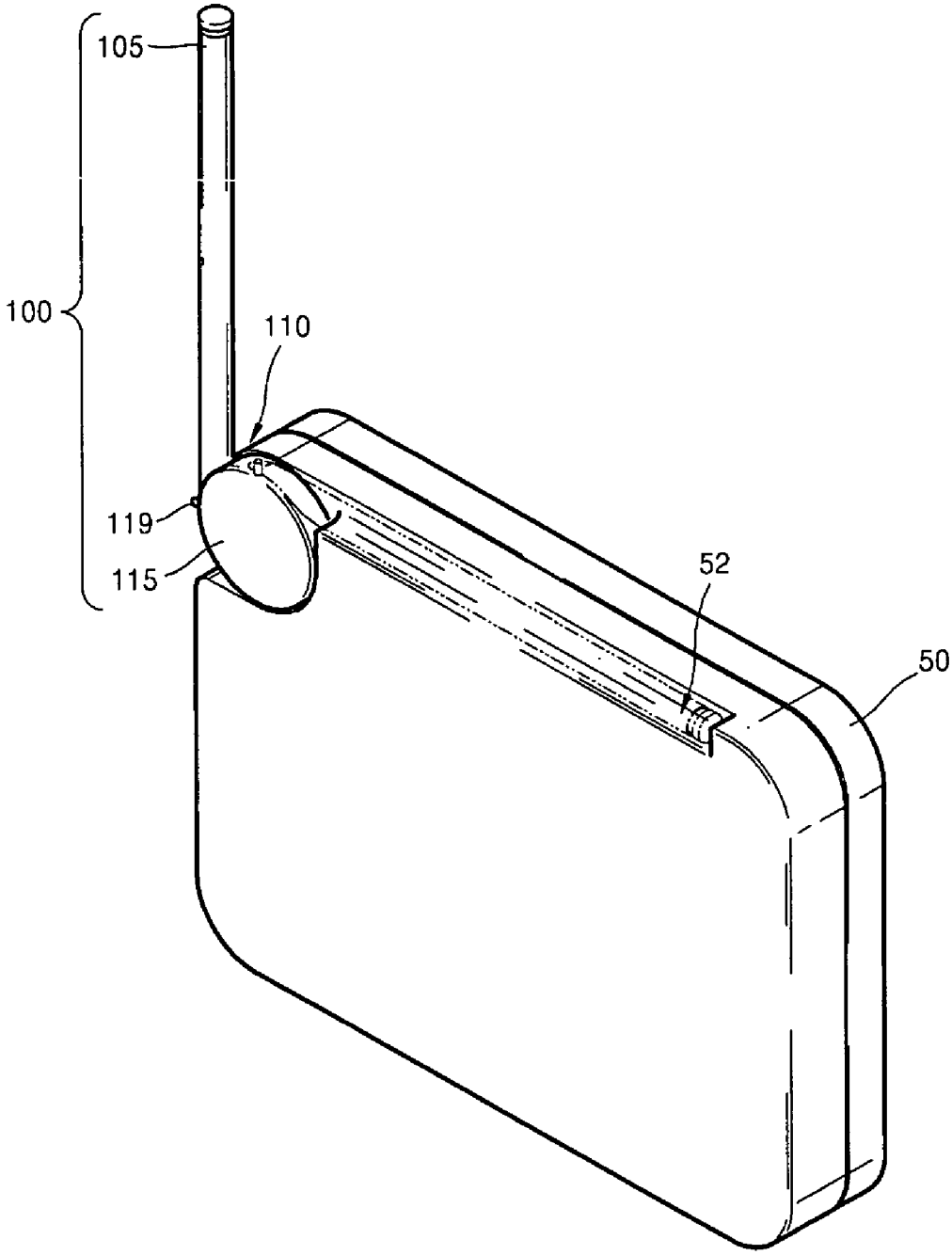
FIG. 2 is a perspective view illustrating an electronic device including an antenna according to an exemplary embodiment of the present invention.

FIG. 2 is a perspective view illustrating an electronic device including an antenna according to an exemplary embodiment of the present invention. Referring to FIG. 2, an antenna 100 according to the present embodiment is pivotably attached to a rear surface of a body 50 of a portable electronic device such as a mobile telephone, personal digital assistant (PDA), a personal multimedia player (PMP), or any other electronic device requiring an antenna. The antenna 100 includes an antenna stick 105 and an antenna hinge 110 mounted at a distal end of the body 50 so as to enable the antenna stick 105 to pivot about the portable electronic device body 50. If radio waves are required to be received, the antenna stick 105 stands on the portable electronic device body 50 in an open position, as marked with a solid line. However, if radio waves are not required to be received or the electronic device is not in use, the antenna stick 105 is folded to overlap with the portable electronic device body 50 in a closed position, as shown in a dotted line. Here, the antenna stick 105 is inserted into an antenna stick insertion groove 52 formed in the rear surface of the portable electronic body 50 to hide behind a front surface of the portable electronic device body 50. The antenna hinge 110 includes a first connector 115 and a handle 119 attached to the first connector 115. The user of the portable electronic device may press the handle 119, causing the first connector 115, as well as the antenna hinge 110 and the antenna 100, to pivot in a clockwise or counterclockwise direction, depending on the direction in which the user presses the handle 119.

Figure 3A:
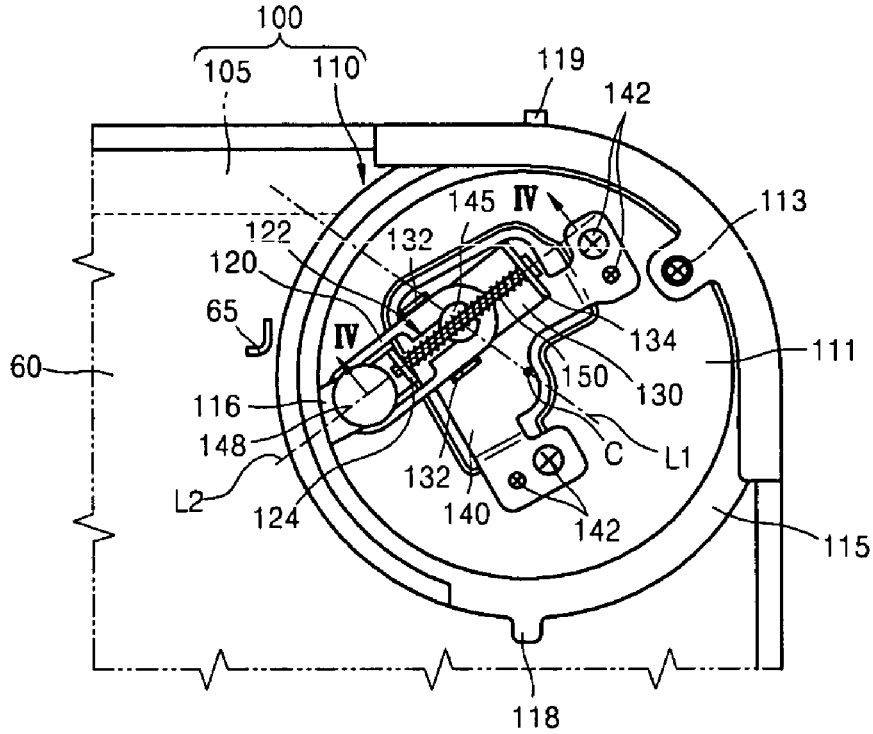
FIGS. 3A through 3E are plan views sequentially illustrating operations of the antenna shown in FIG. 2.
Figure 3B:
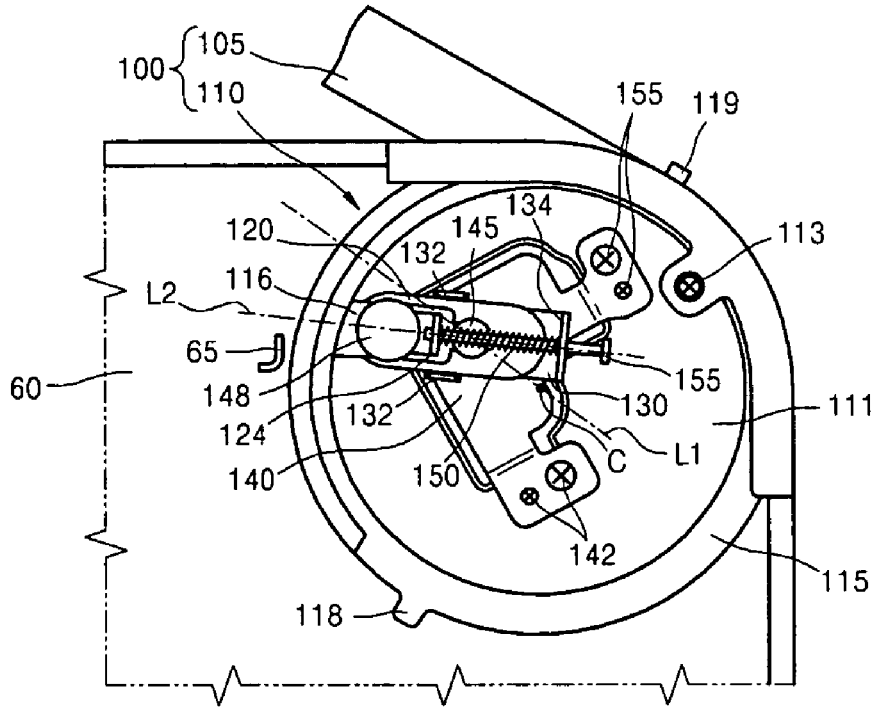
Figure 3C:
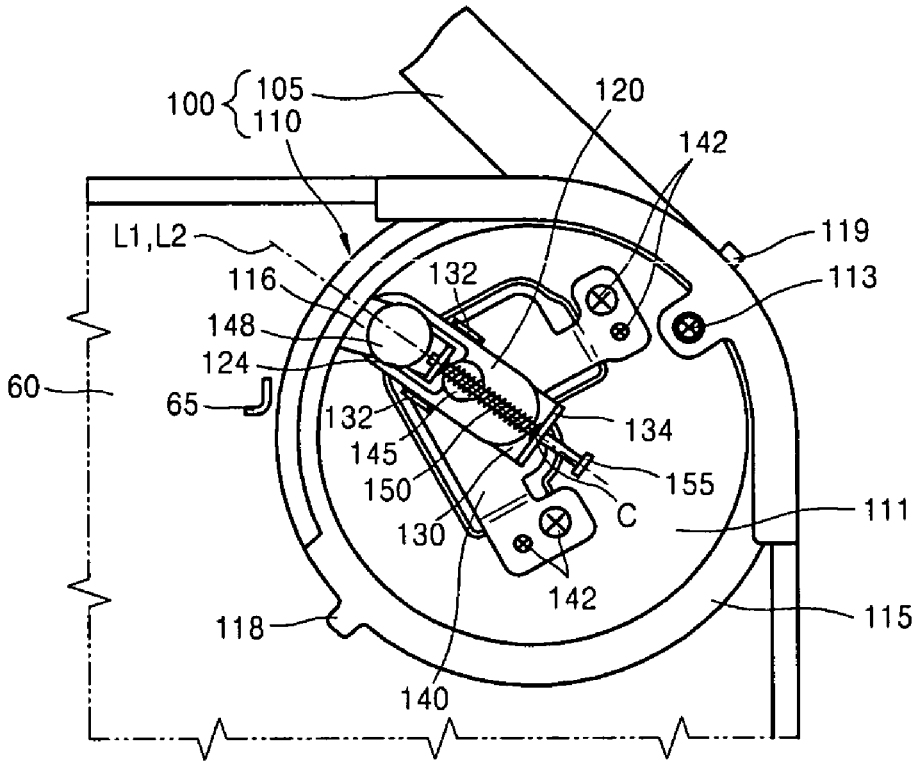
Figure 3D:
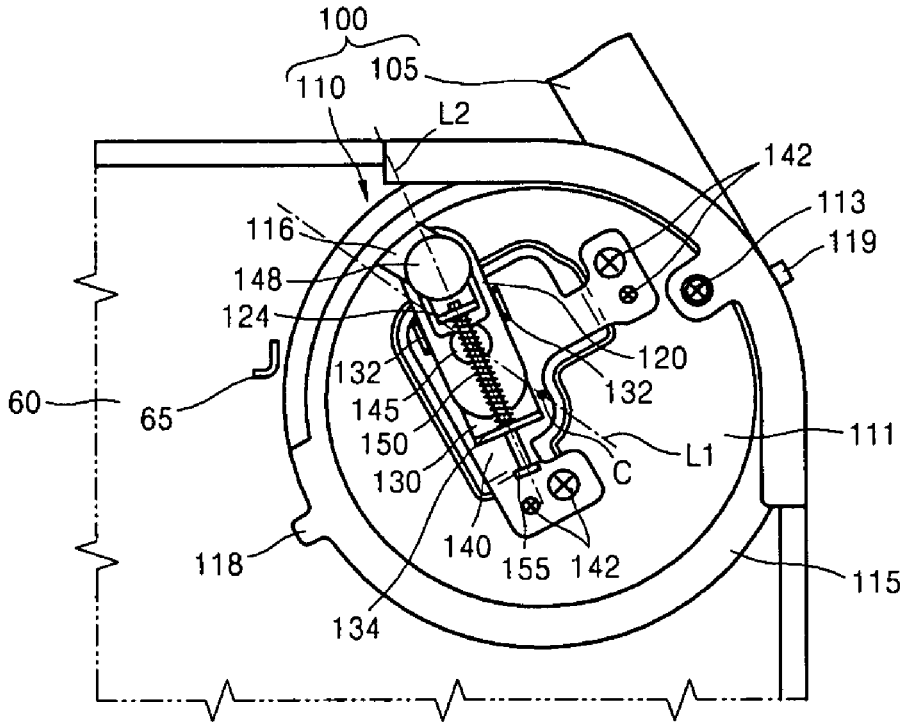
Figure 3E:
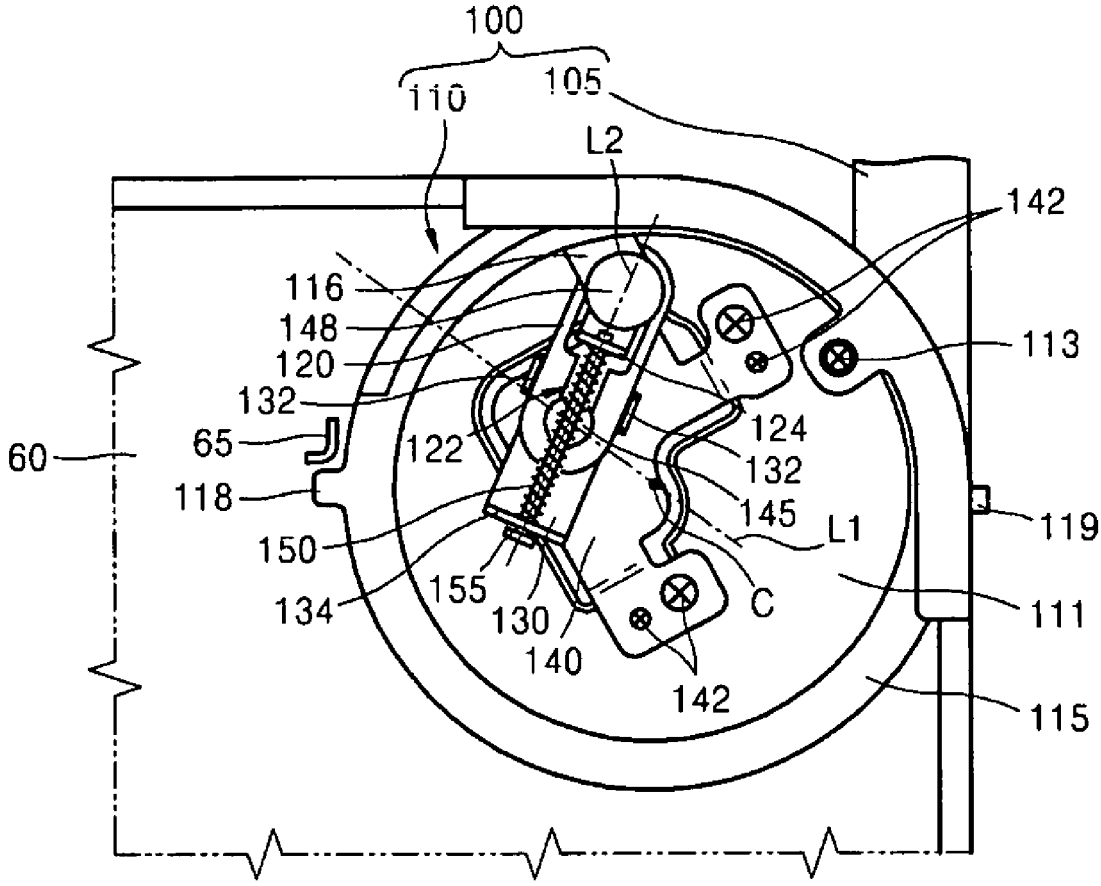
Figure 4:
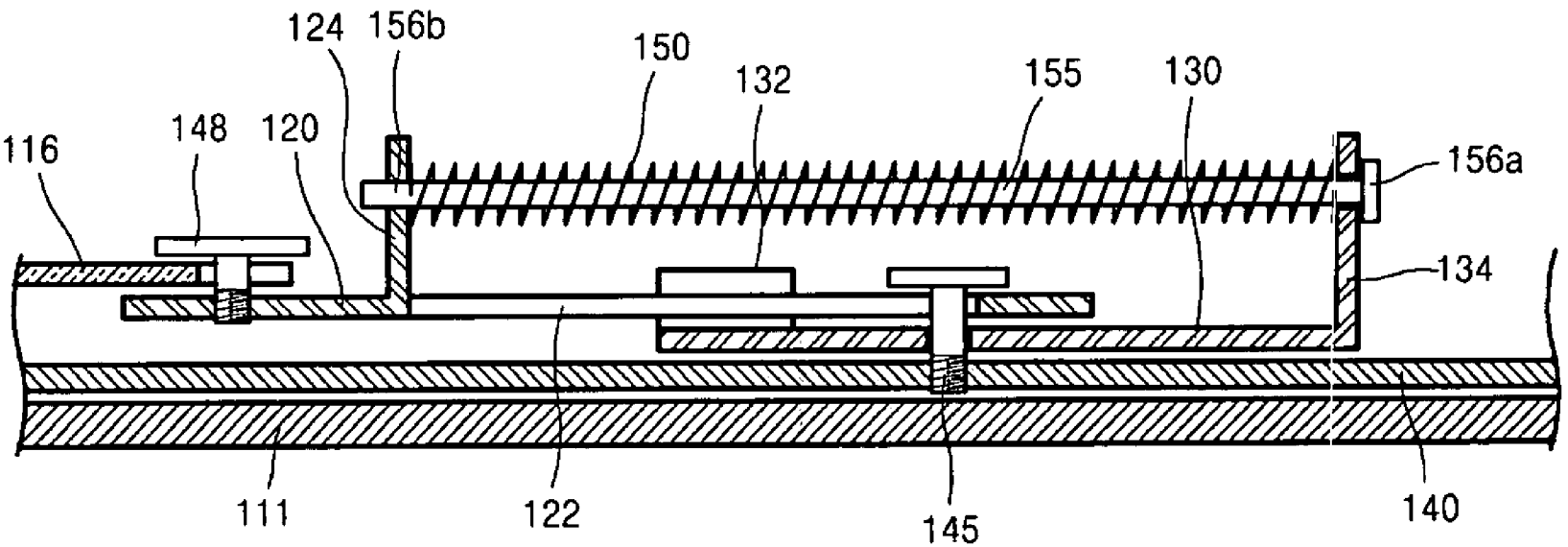
FIG. 4 is a cross-sectional view taken along line IV-IV of FIG. 3A.

FIGS. 3A through 3E are plan views sequentially illustrating operations of the antenna 100 illustrated in FIG. 2. FIG. 3A shows the antenna 100 in the closed position. FIGS. 3B and 3C show the antenna 100 after the pivoting of the first connector 115 has caused the antenna stick 105 to stand at an incline of about 30°, 45°, and 60°, respectively. FIG. 3E shows the antenna in the open position. FIG. 4 is a cross-sectional view taken along line IV-IV shown in FIG. 3A.

Referring to FIGS. 3A and 4, the antenna hinge 110 includes a support plate 111 and a first connector 115. The support plate 111 has a disc shape and is fixed to and combined with the portable electronic device body 50, and in particular to a frame 60 inside the portable electronic device body 50. According to other aspects of the present invention, the support plate 111 may be attached to other parts of the electronic device body 50. The first connector 115 is connected to the antenna stick 105 and to the support plate 111 to pivot clockwise and counterclockwise. Reference numeral 113 denotes a screw fixing the support plate 111 to the frame 60, and reference character C denotes a pivot center along which the first connector 115 pivots. According to other aspects of the invention, screw 113, as well as other screws referred to in the description, may be any type of fastener or adhesive, such as a nail, staple, or glue.

The antenna hinge 110 further includes first and second studs 145 and 148. The first stud 145 is provided as an example of a second connector, which deviates from the pivot center C of the first connector 115 and is fixed with respect to the support plate 111. The second stud 148 is provided as an example of a third connector moving with the clockwise and counterclockwise pivot of the first connector 115. Other aspects of the present invention may use other forms of fasteners or adhesives as the second and third connectors. The second stud 148 is linked to with the pivot of the first connector 115 through a connection part 116 of the first connector 115. The first stud 145 is combined with and supported by a first stud support bracket 140, and the first stud support bracket 140 is screwed to screws 142 to be fixed on the support plate 111.

The second stud 148 is combined with and supported by an end of a first bracket 120. The first bracket 120 is connected to the first stud 145 so as to pivot and slides on the first stud 145. The first bracket 120 slides only along a virtual second straight line L2 connecting the first and second studs 145 and 148 due to a guide slit 122 formed in the first bracket 120, but does not slide in other directions. The antenna hinge 110 further includes a second bracket 130 which is pivotably connected to the first stud 145. A pivot center of the second bracket 130 is the first stud 145. The second bracket 130 includes a guide protrusion 132 so that the second and first brackets 130 and 120 pivot together.

The antenna hinge 110 further includes a spring 150 elastically disposed on the second straight line L2. The spring 150 may be a coil type compression spring, and includes an end supported by a first spring support part 124 formed at the first bracket 120 and an other end supported by a second spring support part 134 formed at the second bracket 130. A spring guide stick 155 penetrates and supports the spring 150 so that the spring 150 is not bent during a contraction of the spring 150. An end 156*b* of the spring guide stick 155, shown in FIG. 4, is combined with the first spring support part 124 of the first bracket 120 to be fixed to the first spring support part 124. A head 156*a* of the spring guide stick 155, shown in FIG. 4, is combined with the second spring support part 134 of the second bracket 130 to slide into and/or out of the second spring support part 134. The spring 150 has a length directly proportional to a distance between the first and second studs 145 and 148, due to the above support structure of the spring 150. According to other aspects of the present invention, spring 150 may be any device providing a restoring force, and the spring support parts 124 and 134 may support any device providing a restoring force.

The antenna 100 further includes a handle 119 that can pivot the first connector 155 via human power. The handle 119 is formed in a protrusion shape on an outer surface of the first connector 115 and protrudes outside the portable electronic device body 50 shown in FIG. 2. The antenna 100 further includes a stopper limiting the pivot range of the antenna stick 105. A collision protrusion 118, formed in a protrusion shape on an outer surface of the first connector 115 to protrude toward the frame 60, as well as a collision wall 65, formed on the frame 60, function as a stopper to limit the clockwise pivot range of the antenna stick 105 when the antenna stick 105 stands. The antenna stick insertion groove 52 shown in FIG. 2 functions as a stopper to limit the counterclockwise pivot range of the antenna stick 105 when the antenna stick 105 is folded.

An operation of the antenna 100 will now be described with reference to FIGS. 3A through 3E. Referring to FIG. 3A, the antenna stick 105 is inserted into the antenna stick insertion groove 52, shown in FIG. 2, to hide behind a front surface of the portable electronic device body 50, also shown in FIG. 2. Here, the spring 150 is in a neutralized or slightly compressed state and the antenna 100 is in the closed position. If a user presses the handle 119 so that the first connector 115 pivots clockwise, the second stud 148 pivots clockwise with the pivot of the first connector 115 based on the pivot center C of the first connector 115, and thus approaches a point on a first straight line L1 connecting the pivot center C and the first stud 145 as shown in FIG. 3B.

The first bracket 120, supporting the second stud 148, pivots clockwise based on the first stud 145 due to the pivot of the second stud 148 and slides along the virtual second straight line L2 toward the first stud) 45. The second bracket 130 pivots with the pivot of the first bracket 120 by the angle by which the first bracket 120 pivots, based on the first stud 145, and does not slide. The distance between the spring support part 124 of the first bracket 120 and the spring support part 134 of the second bracket 130 is reduced due to the sliding of the first bracket 120. Also, the spring 150 interposed between the spring support parts 124 and 134 is shortened and compressed. Referring to FIG. 3B, the antenna stick 105 connected to the first connector 115 inclines at an angle of about 30°.

As the user continues to press the handle 119 in the same direction (so that the first connector 115 pivots clockwise), the second stud 148 continues to pivot so as to be positioned on a point on the first straight line L1, and the first and second straight lines L1 and L2 overlap with each other as shown in FIG. 3C. At this point, the distance between the spring support part 124 of the first bracket 120 and the spring support part 134 of the second bracket 130 is minimized, and the spring 150 interposed between the spring support parts 124 and 134 is compressed to the maximum. As shown in FIG. 3C, the antenna stick 105 connected to the first connector 115 stands to incline at an angle of about 45°.

Referring to FIG. 3D, although the user is no longer pressing the handle 119, after the second stud 148 passes the first straight line L1, the first connector 115 and the antenna stick 105 continue to pivot clockwise automatically due to the elastic restoring force of the spring 150. In detail, the first bracket 120 slides and pivots on the first stud 145 to space the spring support parts 124 and 134 apart from each other so as to extend the spring 150. Thus, the second stud 148 and the first connector 115 connected to the second stud 148 continue to pivot clockwise around the pivot center C. As a result, the antenna stick 105 connected to the first connector 115 also continues to pivot clockwise. As shown in FIG. 3D, the antenna stick 105 stands to incline at an angle of about 60°.

The first connector 115 and the antenna stick 105 continue to pivot clockwise due to the elastic restoring force of the spring 150 and stops pivoting when the collision protrusion 118 on the outer surface of the first connector 115 and the collision wall 65 of the frame 60 collide with each other as shown in FIG. 3E. Here, the spring 150 is in a neutralized or slightly compressed state, and the antenna stick 105 stands vertically.

A process of folding the standing antenna stick 105 to hide the antenna stick 105 is a reverse order of standing the antenna stick 105. In brief, if the handle 119 is pressed toward an opposite direction along which the antenna stick 105 stands until the second stud 148 passes the first straight line L1 counterclockwise, the compressed spring 150 extends due to the elastic restoring force. Thus, although the handle 119 is not pressed any more, the first connector 115 and the antenna stick 105 pivot counterclockwise until the antenna stick 105 is inserted into the antenna stick insertion groove 52 shown in FIG. 2.

It has been described that a pivot operation of antenna stick is realized using a compression spring. However, the pivot operation of the antenna stick may be realized using a tension spring. In this case, if the antenna stick, due to a human power, pivots to a position in which the tension spring extends longest the tension spring shrinks due to an elastic restoring force. Thus, the antenna stick continuously pivots in the same direction to stand or be folded.

As described above, in an antenna according to the present invention, an antenna stick can easily stand or fold without a great force. Also, the antenna stick can smoothly pivot so as to improve qualities of an electronic device and the antenna.

While there have been illustrated and described what are considered to be example embodiments of the present invention, it will be understood by those skilled in the art and as technology develops that various changes and modifications may be made and equivalents may be substituted for elements thereof without departing from the true scope of the present invention. Many modifications, permutations, additions and sub-combinations may be made to adapt the teachings of the present invention to a particular situation without departing from the scope thereof. For example, any device capable of providing a restoring force may be used in place of spring 150. Accordingly, it is intended, therefore, that the present invention not be limited to the various exemplary embodiments disclosed, but that the present invention includes all embodiments falling within the scope of the appended claims.

What is claimed is:

1. An antenna comprising:

an antenna stick; and an antenna hinge to pivotably attach the antenna stick to an electronic device body, wherein the antenna hinge comprises:

a support plate fixed to the electronic device body;

a first connector connected to the antenna stick so as to pivot between a closed position and an open position;

a second connector fixed to the support plate at a location other than a pivot center of the first connector;

a third connector coupled to the first connector so as to pivot with the first connector; and a spring coupled to the third connector and having an elastic force varying with the distance between the second connector and the third connector, wherein if the first connector pivots in a given direction until the first connector has pivoted beyond a predetermined point, the first connector continues to pivot in the given direction due to the elastic restoring force of the spring.

2. The antenna of claim 1, wherein the spring is disposed between the second connector and the third connector so as to extend and/or shorten.

3. The antenna of claim 1, wherein the second connector and the third connector include a first stud and a second stud, respectively.

4. The antenna of claim 3, further comprising a first bracket supporting the second stud and connected to the first stud so as to slide and pivot on the first stud.

5. The antenna of claim 4, further comprising a second bracket pivotably connected to the first stud, wherein the spring is interposed between the first and second studs.

6. The antenna of claim 5, further comprising a spring guide stick, wherein the spring is a coil spring, and the spring guide stick penetrates the coil spring to support the coil spring.

7. The antenna of claim 3, further comprising a first stud support bracket supporting the first stud and fixed to and supported by the support plate.

8. The antenna of claim 1, wherein the spring is a compression spring, wherein the spring is compressed until the third connector passes the predetermined point but extends if the third connector passes the predetermined point.

9. The antenna of claim 8, wherein the predetermined point is the point where the spring reaches maximum compression.

10. The antenna of claim 1, further comprising a stopper limiting a pivot range of the antenna stick.

11. The antenna of claim 1, further comprising a handle pivoting the first connector using a human power.

12. The antenna of claim 1, wherein the spring is a tension spring; and wherein the spring is extended until the third connector passes the predetermined point but is compressed if the third connector passes the predetermined point.

13. An antenna system comprising:

an antenna stick; and an antenna hinge pivotably attaching the antenna to an electronic device so as to pivot the antenna between an open position and a closed position;

wherein, after the antenna hinge has pivoted in a given direction beyond a predetermined point, the antenna hinge automatically continues to pivot the antenna stick in the given direction, and wherein the antenna hinge comprises:

a support plate fixed to and combined with a body of the electronic device;

a first connector connected to the antenna stick and pivotably combined with the support plate;

a second connector deviating from a pivot center of the first connector and fixed with respect to the support plate;

a third connector moving with the pivot of the first connector; and a spring disposed between the second connector and the third connector;

wherein, if the first connector pivots until the third connector passes a virtual straight line connecting the pivot center of the first connector and the second connector, the first connector continuously pivots in an identical direction due to an elastic restoring force of the spring.

14. The antenna system of claim 13, further comprising a stopper to limit a pivot range of the antenna stick.

15. The antenna system of claim 13, wherein the predetermined point is the point where the spring reaches maximum compression.

16. An antenna system comprising:

an antenna stick; and an antenna hinge mounted to a distal end of an electronic device to support the antenna stick to pivot about the electronic device between a closed position and an open position, the antenna hinge comprising:

a support plate affixed to the electronic device;

a connector connected to the support plate and the antenna stick so as to enable the antenna stick to pivot between the closed position and the open position;

a support bracket fixed to the support plate;

a first stud provided on the support bracket deviating from a pivot center of the first connector;

a second stud provided on the support bracket moving with the pivot of the first connector;

a first bracket connected to the first stud to support the second stud so as to pivot about the first stud and to slide along a guide connecting the first stud and the second stud;

a second bracket connected to the first stud so as to pivot about the first stud along with the first bracket; and a spring having an elastic force varying with a distance between the first stud and the second stud, wherein, if the connector pivots in a given direction until the connector has pivoted beyond a predetermined point, the connector continues to pivot in the given direction due to the elastic restoring force of the spring.

17. The antenna system of claim 16, wherein the spring is disposed between the first stud and the second stud so as to extend and/or shorten.

18. The antenna system of claim 16, wherein the spring is a coil type compression spring having one end supported by the first bracket and an opposite end supported by the second bracket.

19. The antenna system of claim 16, further comprising a handle protruding from an outer surface of the connector which, when pressed by a user, causes the connector to pivot between the closed position and the open position.

20. The antenna system of claim 16, further comprising a stopper disposed to limit a pivot range of the antenna stick.

* * * * *